US006926192B1

(12) United States Patent
Dowd

(10) Patent No.: US 6,926,192 B1
(45) Date of Patent: Aug. 9, 2005

(54) COLLAPSIBLE MOVIE FILM BOX WITH AUTOMATIC LOCKING BOTTOM

(75) Inventor: Fred Dowd, Princeton, MA (US)

(73) Assignee: Technology Container Corporation, Shrewsbury, MA (US)

( * ) Notice: Subject to any disclaimer, the term of this patent is extended or adjusted under 35 U.S.C. 154(b) by 31 days.

(21) Appl. No.: 10/705,427

(22) Filed: Nov. 10, 2003

(51) Int. Cl.[7] ..... B65D 5/10
(52) U.S. Cl. ..... 229/117; 229/117.24; 229/148
(58) Field of Search ..... 229/117.24, 117.23, 229/117.21, 117.22, 122.34, 117, 148

(56) References Cited

U.S. PATENT DOCUMENTS

| | | | | |
|---|---|---|---|---|
| 285,706 | A | 9/1883 | Tatum | |
| 937,173 | A | 10/1909 | Pfeiffer | |
| 1,340,558 | A | 5/1920 | Plummer | |
| 1,620,174 | A | 3/1927 | Wagner | |
| 1,708,700 | A | 4/1929 | Maier | |
| 1,845,891 | A | 2/1932 | Schroeder | |
| 1,953,885 | A | 4/1934 | McAleer | |
| 1,974,061 | A | 9/1934 | Densen | |
| 1,987,063 | A | 1/1935 | Hinton | |
| 2,003,388 | A | 6/1935 | Palmer | |
| 2,173,927 | A | 9/1939 | Allen | |
| 2,179,830 | A | 11/1939 | Plundstein et al. | |
| 2,222,572 | A | 11/1940 | Reger | |
| 2,327,709 | A | 8/1943 | Himes | |
| 2,330,294 | A | 9/1943 | Leavitt et al. | |
| 2,496,043 | A | 1/1950 | Farrell | |
| 2,514,651 | A * | 7/1950 | Kornfeld et al. | 62/457.1 |
| 2,625,315 | A | 1/1953 | Fehrenkamp | |
| 2,751,136 | A | 6/1956 | Moore | |
| 2,760,709 | A | 8/1956 | Bruehl et al. | |
| 2,828,904 | A | 4/1958 | Mires et al. | |
| 3,126,140 | A | 3/1964 | Lizan et al. | |
| 3,194,475 | A | 7/1965 | Ralston | |
| 3,199,763 | A | 8/1965 | Anderson | |
| 3,328,189 | A | 6/1967 | Bauer | |
| 3,727,825 | A | 4/1973 | Troth | |
| 3,727,826 | A | 4/1973 | Shepherd | |
| 3,743,081 | A | 7/1973 | Roberg et al. | |
| 3,949,929 | A | 4/1976 | Kupersmit | |
| 4,003,515 | A * | 1/1977 | Steele | 229/117.15 |
| 4,017,019 | A * | 4/1977 | Booth | 229/113 |
| 4,171,763 | A * | 10/1979 | Card | 229/117.15 |
| 4,187,976 | A | 2/1980 | Mather | |
| 4,289,268 | A | 9/1981 | Paige | |
| 4,308,995 | A | 1/1982 | Hanes | |
| 4,507,348 | A | 3/1985 | Nagata et al. | |
| 4,530,460 | A | 7/1985 | Hinton | |
| 4,559,259 | A | 12/1985 | Cetrelli | |
| 4,682,727 | A | 7/1987 | Stoll | |

(Continued)

OTHER PUBLICATIONS

The Witey: Encyclopedia of Packaging Technology, "Corrugated Plastic", 3 pages.
http://www.coroplast.com/products/products.html, "Our Products at Coroplast," Dec. 11, 2002, 2 pages.
http://www.primexplastics.com/products/corx.htm, "Cor-X R (Corrugated)," Dec. 11, 2002, 1 page.

*Primary Examiner*—Tri M. Mai
(74) *Attorney, Agent, or Firm*—William F. Lang, IV; Eckert Seamans Cherin & Mellott, LLC

(57) ABSTRACT

A collapsible, automatically locking box is appropriately sized for transporting the typically five to seven reels of film of a complete movie, and includes the reinforced bottom and top necessary to support the weight of the complete movie.

13 Claims, 7 Drawing Sheets

U.S. PATENT DOCUMENTS

| | | | | |
|---|---|---|---|---|
| 4,763,833 | A | 8/1988 | Stoll | |
| 4,834,255 | A | 5/1989 | Boots | |
| 4,948,039 | A | 8/1990 | Amatangelo | |
| 5,114,034 | A | 5/1992 | Miller et al. | |
| 5,205,412 | A | 4/1993 | Krieg | |
| 5,232,149 | A | 8/1993 | Stoll | |
| 5,267,645 | A | 12/1993 | Tokunaga et al. | |
| 5,335,789 | A | 8/1994 | Taravella et al. | |
| 5,407,125 | A | 4/1995 | Yates et al. | |
| 5,454,560 | A | 10/1995 | Pan | |
| 5,472,088 | A | 12/1995 | Roberts et al. | |
| 5,503,324 | A | 4/1996 | Bacchetti et al. | |
| 5,664,726 | A | 9/1997 | Opper | |
| 5,720,617 | A | 2/1998 | Var | |
| 5,728,478 | A | 3/1998 | Wilson et al. | |
| 5,848,749 | A | 12/1998 | Ljungstrom | |
| 5,927,593 | A | 7/1999 | Berkowitz et al. | |
| 5,953,858 | A | 9/1999 | Loosen | |
| 6,102,279 | A | 8/2000 | Dowd | |
| 6,102,280 | A | 8/2000 | Dowd | |
| 6,209,782 | B1 * | 4/2001 | Chou et al. | 229/117.15 |
| 6,257,484 | B1 | 7/2001 | Dowd | |
| 6,349,876 | B1 | 2/2002 | Dowd | |

* cited by examiner

COLLAPSIBLE MOVIE FILM BOX WITH AUTOMATIC LOCKING BOTTOM

BACKGROUND OF THE INVENTION

1. Field of the Invention

The present invention provides a collapsible box having an automatically locking bottom for transporting reels of movie film. The present invention further provides a method of transporting movies.

2. Description of the Prior Art

The reels of film on which movies are typically supplied to theaters weigh approximately 10 pounds each, and are presently transported using metal or plastic film cans, with each film can holding up to four reels of film. The cans typically weigh approximately eight pounds, and do not collapse when empty. Therefore, the use of these cans not only increases the cost of shipping a movie by increasing the total weight that must be shipped, but also increase the cost of shipping the empty containers, and the amount of space required to store empty containers. Furthermore, a typical movie requires five to seven reels of film, requiring two film cans to hold an entire movie. The use of more than one film can increases the risk that only part of a movie will arrive at its desired destination. Lastly, each of these film cans is expensive, costing over $22.00 each.

Some examples of presently available collapsible boxes having automatically locking bottoms include U.S. Pat. Nos. 6,102,279 and 6,102,280, having the same inventor and assignee as the present invention. Although these boxes perform their intended applications quite well, the references fail to teach or suggest the specific reinforcements necessary to carry the 50–70 pounds that a typical series of film reels for a movie will weigh.

Accordingly, there is a need for a box having a collapsible, automatically locking bottom, capable of containing and supporting the weight of a complete movie.

SUMMARY OF THE INVENTION

The present invention provides a collapsible box having an automatically locking bottom, capable of holding the five to seven 10-pound reels of 35 mm. film or other media typically used to contain a single movie (although the box could be sized to hold different numbers of reels). Further, the present invention provides a box capable of supporting the weight of the movie. Lastly, the present invention provides a method of transporting the movie.

The box includes a collapsible, automatically locking bottom having four panels. A first bottom panels extends substantially across all of the bottom. A second bottom panel and third bottom panel are each adjacent to the first bottom panel. A fourth bottom panel is located between the second and third bottom panels. The second bottom panel includes a live hinge defining a flap, with the flap being secured to the first bottom panel. Likewise, the third bottom panel includes a live hinge defining a flap, with the third flap being secured to the fourth bottom panel. A fifth bottom panel, covering substantially the entire bottom, may be placed atop the first, second, third and fourth bottom panels. To support the weight of a movie, it is not only preferable to reinforce the bottom, but also the top. The top of the box includes a first top panel, a second top panel adjacent to the first top panel, a third top panel on the other side of the first top panel, and a fourth panel between the second and third top panels. The first top panel includes a pair of openings dimensioned and configured to receive a handle. A reinforcement plate having corresponding openings is secured beneath the first top panel. A preferred handle has a T-shaped end passing through each of these openings, securing the first top panel, reinforcing panel, and handle together. Each of the second, third, and fourth top panels define openings structured to receive the handle. When all four top panels are folded over the top of the box to close the box, the handle thereby passes through all four panels, so that all four panels are supporting the weight of the box and its contents.

The box is preferably dimensioned and configured so that the five to seven film reels required for a complete movie may fit within the box. Preferably, these reels fit within the box standing on their edge, thereby permitting visual verification that the box contains the correct reels without the need to remove any of the reels from the box.

Accordingly, it is an object of the present invention to provide a collapsible, automatically locking bottom for a box for transporting movies, and capable of supporting the weight of an entire movie.

It is another object of the invention to provide a box dimensioned and configured to contain an entire movie.

It is a further object of the present invention to provide a box for transporting movies having a reinforced top so that the box will support the weight of a movie when carried by a handle secured to the top.

It is another object of the present invention to provide a box dimensioned and configured to contain the multiple reels of film for a complete movie with the reels standing on their edge, facilitating verification of the contents of the box.

It is a further object of the present invention to provide a box for transporting movies that resist the entrance of water therein when closed.

It is another object of the present invention to provide a box for transporting movies that is inexpensive to purchase.

It is a further object of the present invention to provide a box for transporting movies that reduces the cost of transporting the movies.

It is a further object of the present invention to provide a box for transporting movies that permits the entire movie to be shipped in a single container, thereby reducing the likelihood that a portion of the movie will not reach its destination.

These and other objects of the invention will become more apparent through the following description and drawings.

BRIEF DESCRIPTION OF THE DRAWINGS

Like reference characters denote like elements through the drawings.

DESCRIPTION OF THE PREFERRED EMBODIMENTS

Figure 1:
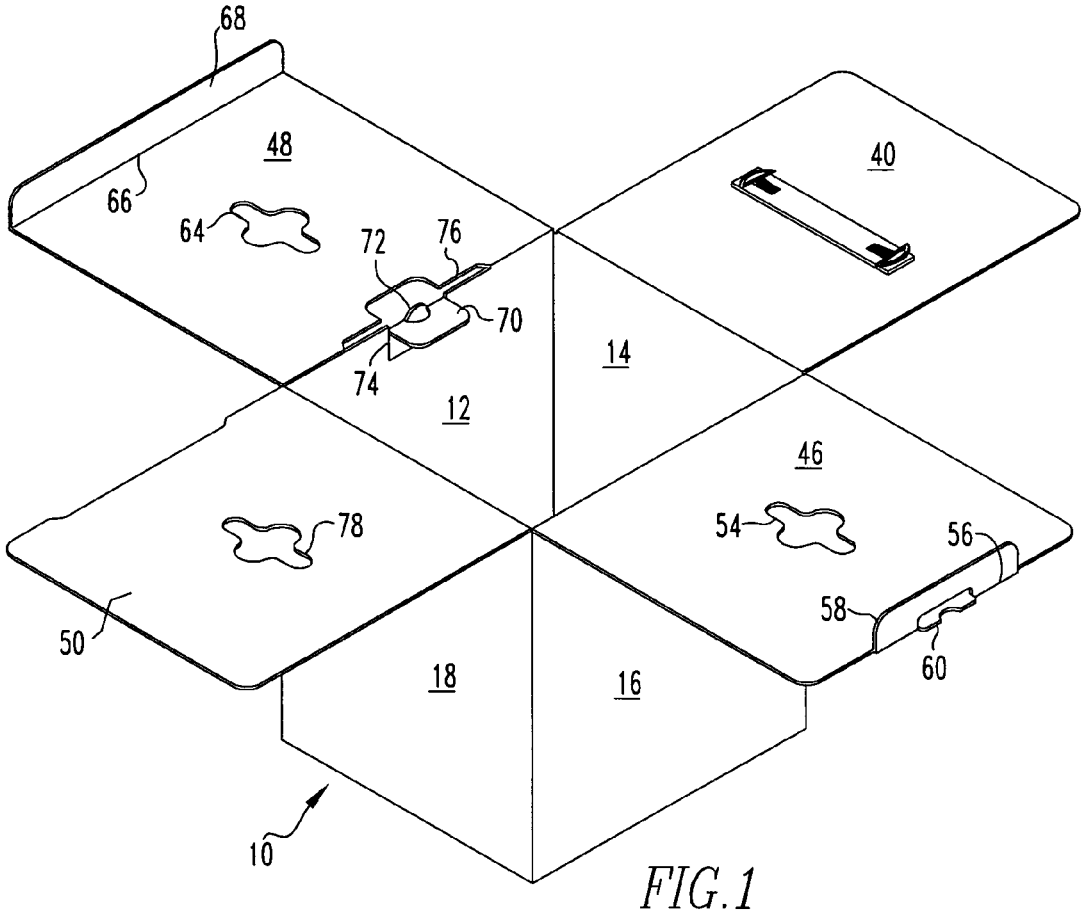
FIG. 1 is an isometric top view of a box according to the present invention.

Referring to FIG. 1, the present invention provides a box 10 for transporting the film reels of a movie.

Figure 2:
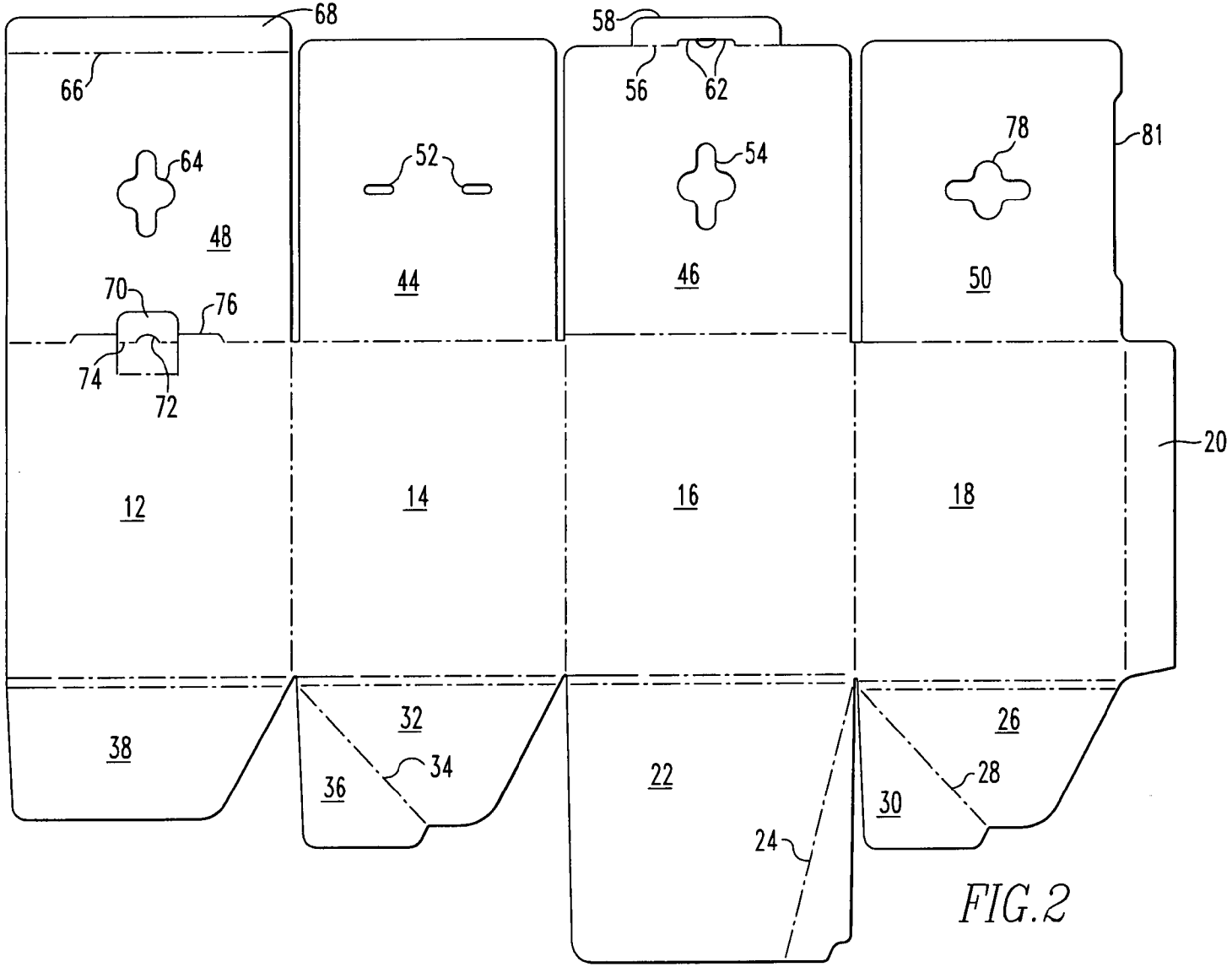
FIG. 2 is a top view of a corrugated plastic panel forming a box according to the present invention, prior to securing the various panels together.
Figure 3:
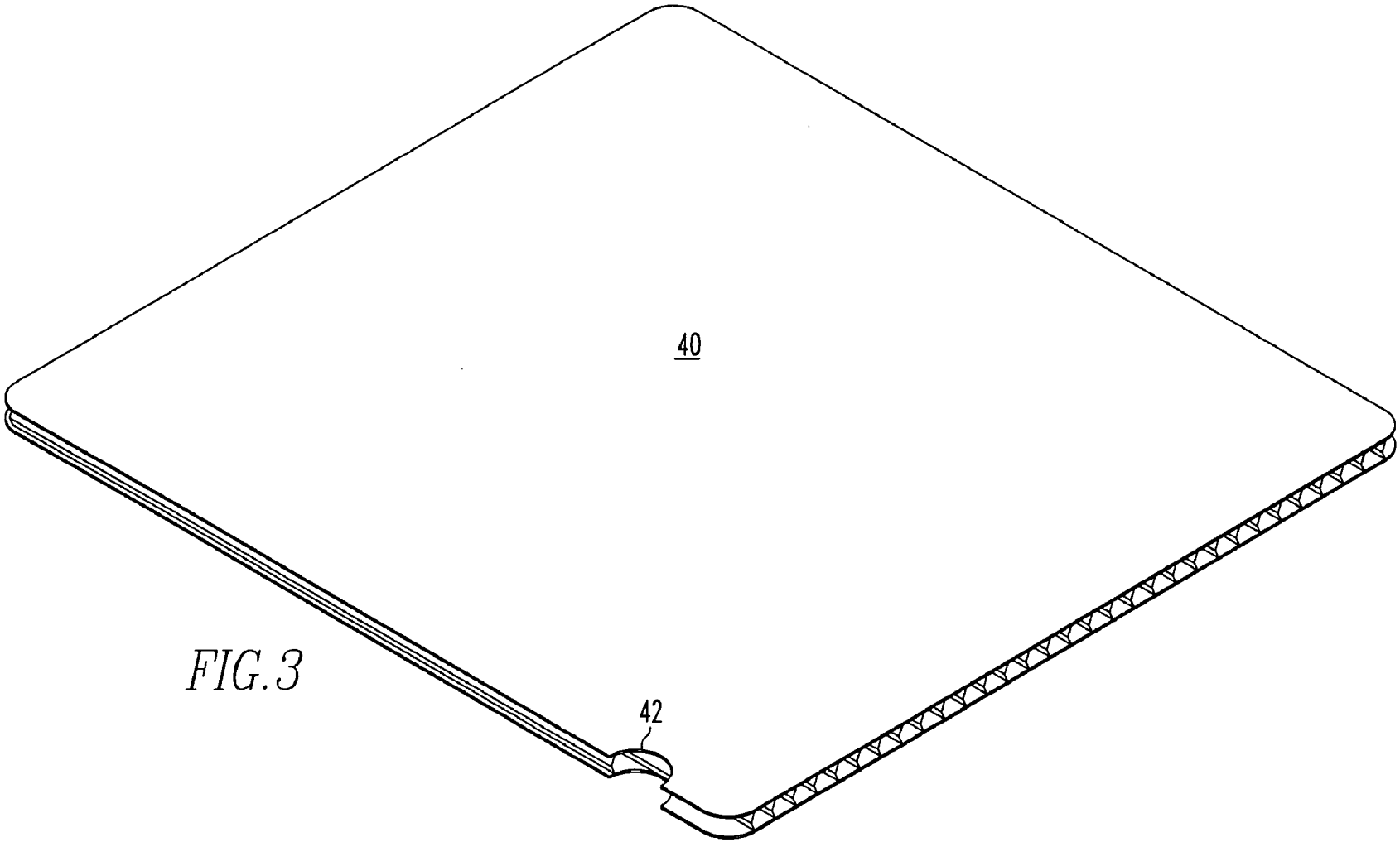
FIG. 3 is a top isometric view of bottom reinforcement panel for a box according to the present invention.

Referring to FIGS. 1 and 2, the box includes a plurality of sides 12, 14, 16, 18. In the illustrated embodiment, a glue flap 20 extends from the side 18 for securing the side 18 to the side 12. A first bottom panel 22 depends from the side panel 16, and in some preferred embodiments defines a live hinge 24. A second bottom panel 26 depends from the side 18, having a live hinge 28 defining a flap 30. A third bottom panel 32 depends from the side 14, having a live hinge 34 defining a flap 36. A fourth bottom panel 38 depends from the side 12. The first bottom panel 22 may be dimensioned and configured to extend across substantially all of the bottom of the assembled box. Although the bottom panels should remain in the same sequence with respect to each other, any of the bottom panels 22, 26, 32, 38 may depend from any of the sides 12, 14, 16, 18 as long as the relationship of the other bottom panels 22, 26, 32, 38 is preserved. Referring briefly to FIG. 3, a fifth bottom panel 40 may be provided atop the bottom panels 22, 26, 32, 38 as described in greater detail below. The fifth bottom panel 40 serves as a reinforcing panel and preferably covers substantially the entire bottom of the box 10, but may provide a finger-receiving cut-out to facilitate removal of the panel 40 from the box 10.

Referring back to FIGS. 1 and 2, a first top panel 44, second top panel 46, third top panel 48, and fourth top panel 50, extending upward from the sides 14, 16, 12, 18, respectively. The top panels 44, 46, 48, 50 may be arranged in any order with respect to each other and with respect to the side panels 12, 14, 16, 18. In the illustrated embodiment, the first top panel 44 defines a pair of handle-receiving openings 52. The second top panel 46 defines an opening 54 dimensioned and configured to receive a handle (described below) and also includes a live hinge 56 defining an end flap 58. The second top panel 46 may also define a slot 60 along the live hinge 56, and one or more finger tabs 62 extending outward pass the end flap 58. The third top panel 48 also defines an opening 64 dimensioned and configured to receive a handle, and a live hinge 66 defining an end flap 68. A closure securing tab, dimensioned and configured to fit within the slot 60, may be defined within the side 12 and third top panel 48. A finger tab 72 may extend outward from a live hinge 74 defined within the securing tab 70, thereby permitting easy withdrawal of the tab 70 from the slot 60. A slot 76, dimensioned and configured to receive the end flap 58, may also be defined between the side panel 12 and third top panel 48. The fourth top panel 50 includes an opening 78 dimensioned and configured to receive a handle, and may also include a recessed section 81 dimensioned and configured to accommodate the end flap 58.

The side panels 12, 14, 16, 18, bottom panels 22, 26, 32, 38, and top panels 44, 46, 48, 50, are preferably cut from a single sheet of suitable material, for example, corrugated plastic, resulting in the sheet illustrated in FIG. 2. Using a water-resistant material such as corrugated plastic provides the additional advantage of making the box resist the entrance of water. The sheet is then folded into the final shape of the box, with the glue flap 20 secured to the side panel 12, preferably by a suitable adhesive. Next, the flap 30 is secured to the first bottom panel 22, preferably by a suitable adhesive. The flap 36 is likewise secured to the fourth bottom panel 38, also preferably by a suitable adhesive.

Figure 4:
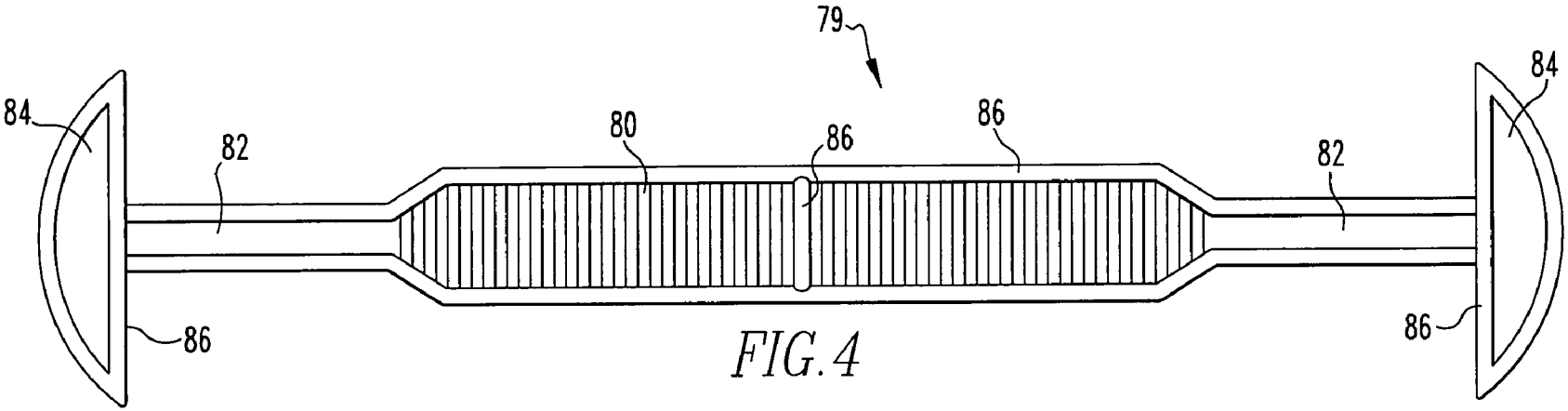
FIG. 4 is a top view of a handle for a box according to the present invention.

The handle 79 is illustrated in FIG. 4. The handle 79 includes a grasping portion 80 having a tapered portion 82 at each end. A handle-securing tab 84 is secured substantially perpendicular to each of the tapered portions 82. Some preferred embodiments of the handle 79 may include reinforcing ribs 86.

Figure 5:
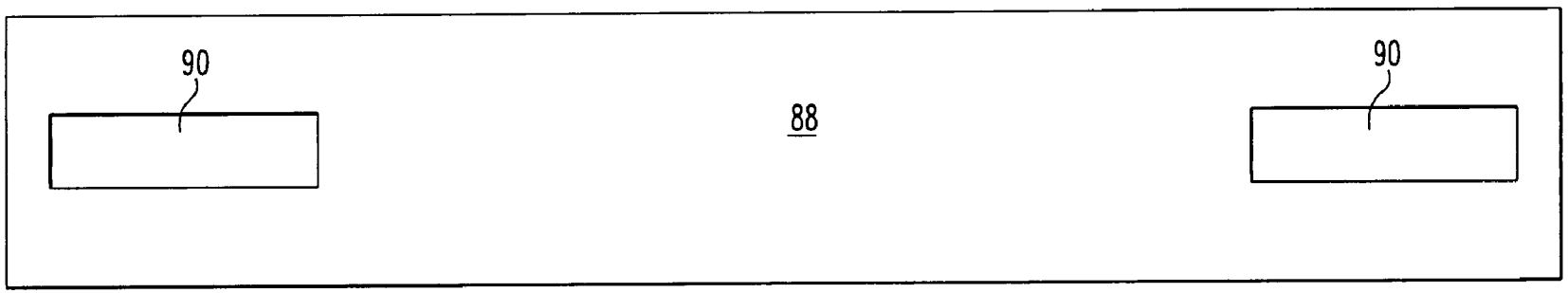
FIG. 5 is a top view of a handle reinforcing panel for a box according to the present invention.
Figure 7:
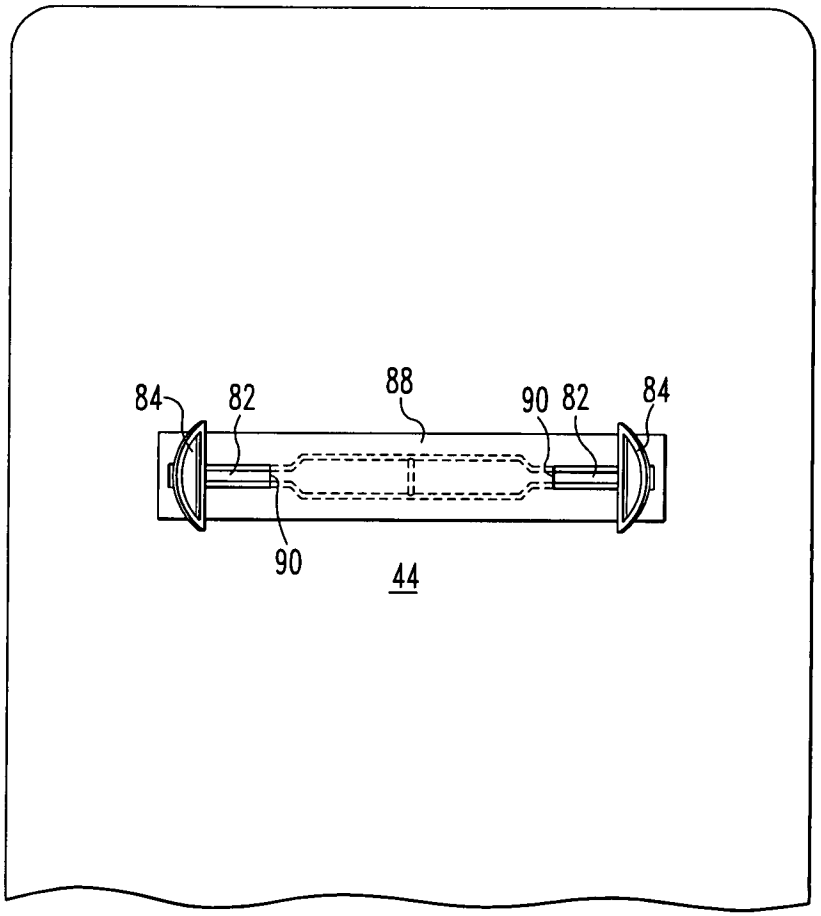
FIG. 7 is a bottom view of a first top panel for a box according to the present invention.
Figure 6:
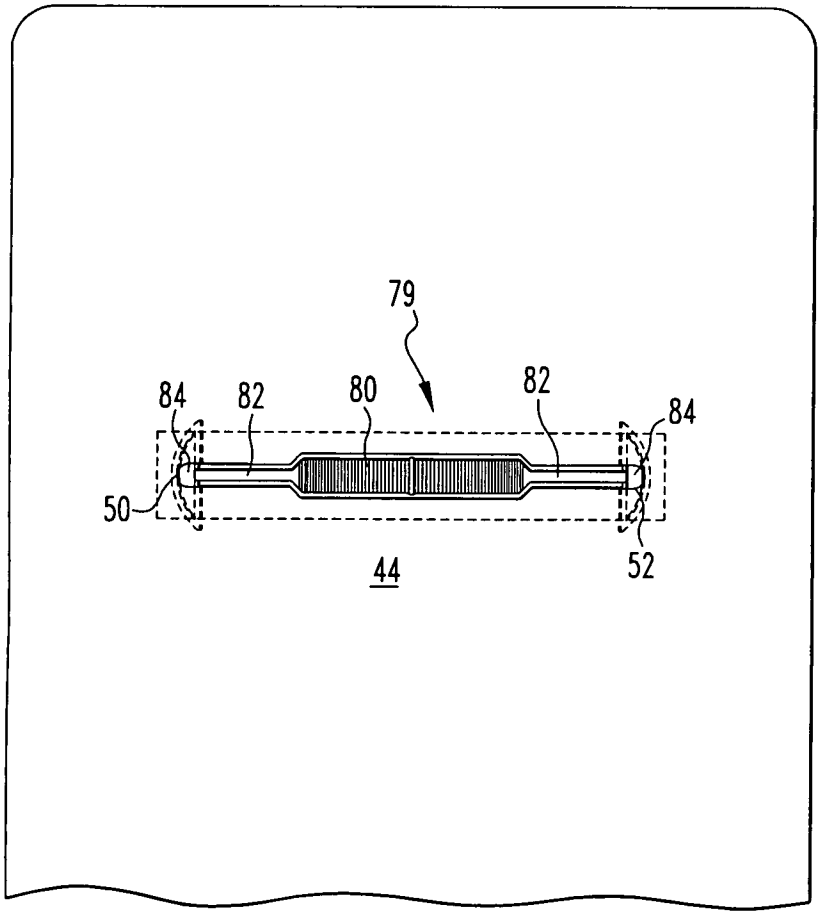
FIG. 6 is a top view of a box according to the present invention.

FIG. 5 illustrates a reinforcement plate 88 for use with the handle 79. The reinforcement plate 88 defines a pair of openings 90 corresponding to the openings 52 in the first top panel 44. Referring to FIGS. 6 and 7, the reinforcement plate 88 is placed underneath the first top panel 44, with the openings 90 aligned with the openings 52. The tabs 84 are then inserted through the openings 52, 90, so that the tapered portions 82 are retained within these openings. The handle 79 is thereby secured to the first top panel 44.

Figure 8:
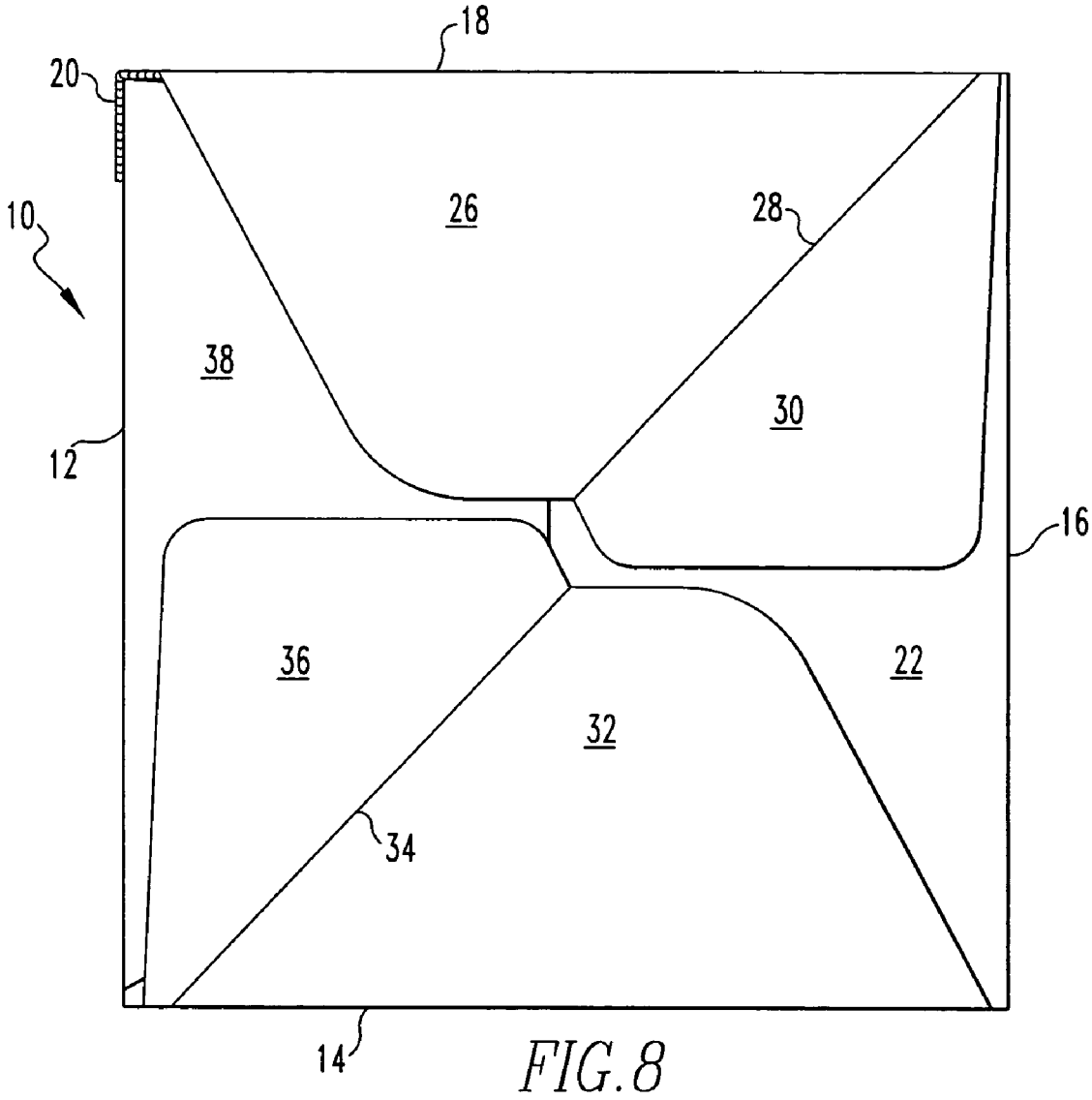
FIG. 8 is a bottom view of a box according to the present invention.

In use, the box 10 may be collapsed by pushing the bottom panels 22, 26, 32, 38 upward into the box 10, while simultaneously pushing the sides 16, 18 closer together, and the sides 12, 14 closer together. To expand the box, the sides 16, 18 and the sides 12, 14 are pulled apart, while simultaneously pushing downward on the bottom panels 22, 26, 32, 38. The live hinge 24 within the first bottom panel 22 facilitates the movement of this panel without interference with the side 18. In the expanded position, the bottom will resemble FIG. 8.

Figure 9:
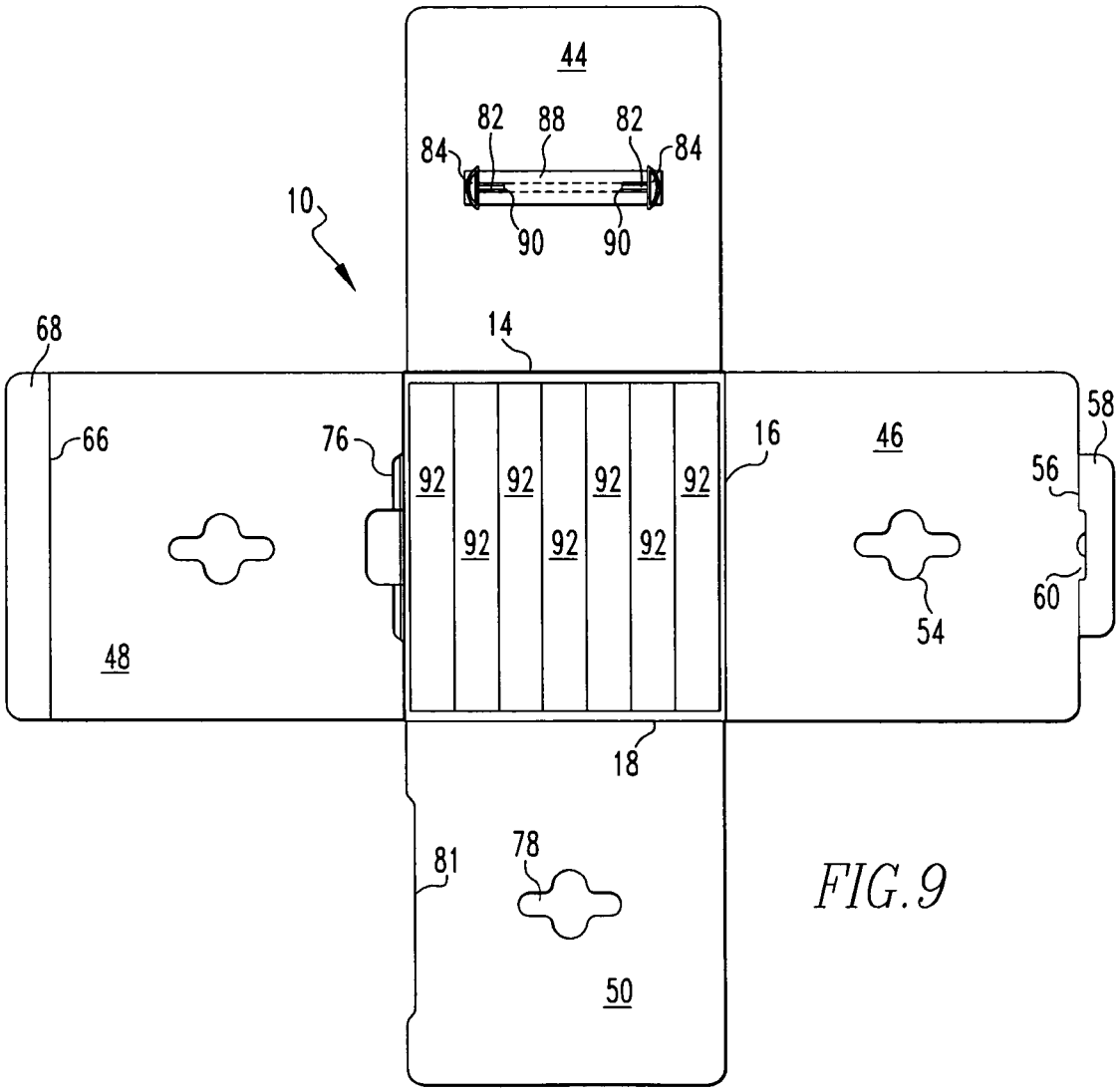
FIG. 9 is a top view of a box according to the present invention containing a movie and showing the top open.

Referring to FIG. 9, movie reels 92 are placed within the box 10, above the bottom panels 22, 26, 32, 38 and the fifth bottom panel 40. The reels 92 are preferably placed in the box 10 with their edge resting on the panel 40. As can be seen in FIG. 9, placing the reels 92 in the box 10 in this manner permits easy verification that the box contains the proper reels without the need to remove the reels 92 from the box. To close the box, the first top panel 44 is first lowered over the box 10. Next, the fourth top panel 50 is lowered over the first top panel 44, and the handle 79 is passed through the opening 78. The third top panel 48 is next lowered over the fourth top panel 50, with the end flap 68 inserted between the panels 44, 50, and the side 16. The handle is passed through the opening 64. Lastly, the second top panel 46 is lowered over the third top panel 48. The handle is passed through the opening 54. The end flap 58 is passed into the slot 76. The tab 70 is inserted into the slot 60 to secure the box in its closed position.

The box 10 of the present invention therefore provides an automatically locking, collapsible box for transporting movie reels 92. The box 10 provides the proper reinforced bottom and top to support the weight of the movie reels 92, and is dimensioned and configured to hold a sufficient number of movie reels 92 for an entire movie. By collapsing the box when not in use, the volume taken up by the box during storage and shipment is drastically reduced, thereby reducing the costs associated with each.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A box for movie reels, comprising:

a collapsible, automatically locking bottom having a first bottom panel extending across substantially all of the bottom, a second bottom panel adjacent to the first bottom panel, a third bottom panel adjacent to the first bottom panel, and a fourth bottom panel between the second and third bottom panels, the first, second, and third bottom panels each having a live hinge defining a first, second, and third flap, the second flap being secured to the first bottom panel, and the third flap being secured to the fourth bottom panel;

a fifth bottom panel atop the first, second, third, and fourth bottom panels, the fifth bottom panel covering substantially the entire bottom; and a top having a first top panel, a second top panel adjacent to the first top panel, a third top panel adjacent to the first top panel, and a fourth top panel between the second and third top panels, the first top panel defining a pair of openings dimensioned and configured to receive a handle, with the handle being secured therein, and a reinforcing member having corresponding openings for receiving the handle, the fourth top panel defining a slot for permitting passage of the handle therethrough, the third top panel defining a slot for permitting passage of the handle therethrough and a hinge defining an end portion dimensioned and configured to fit between the first and fourth top panels and a side, the second top panel defining a slot for permitting passage of the handle therethrough and a hinge defining an end portion dimensioned and configured to fit between the first and fourth top panels and a side.

2. The box according to claim 1:

wherein the second top panel further defines a closure slot adjacent to the hinge; and further comprising a closure flap defined on a side of the box opposite the second top panel, the closure flap being dimensioned and configured to removably fit within the closure slot, the closure flap further defining a vertical portion, a horizontal portion, a live hinge therebetween, and an opening tab protruding upward from the vertical portion.

3. The box according to claim 1, wherein the box is dimensioned and configured to hold a sufficient number of reels of film to comprise an entire movie.

4. The box according to claim 1, wherein the plastic is corrugated plastic.

5. The box according to claim 1, wherein the box is dimensioned and configured to contain reels of movie film with the reels standing on their edge.

6. The box according to claim 1, wherein the fifth bottom panel has a thickness of at least about 10 mm.

7. The box according to claim 1, wherein the box is made from plastic.

8. A method of transporting a movie, comprising:

providing a box having:

a collapsible, automatically locking bottom having a first bottom panel extending across substantially all of the bottom, a second bottom panel adjacent to the first bottom panel, a third bottom panel adjacent to the first bottom panel, and a fourth bottom panel between the second and third bottom panels, the first, second, and third bottom panels each having a live hinge defining a first, second, and third flap, the second flap being secured to the first bottom panel, and the third flap being secured to the fourth bottom panel;

a fifth bottom panel atop the first, second, third, and fourth bottom panels, the fifth bottom panel covering substantially the entire bottom; and a top having a first top panel, a second top panel adjacent to the first top panel, a third top panel adjacent to the first top panel, and a fourth top panel between the second and third top panels, the first top panel defining a pair of openings dimensioned and configured to receive a handle, with the handle being secured therein, and a reinforcing member having corresponding openings for receiving the handle, the fourth top panel defining a slot for permitting passage of the handle therethrough, the third top panel defining a slot for permitting passage of the handle therethrough and a hinge defining an end portion dimensioned and configured to fit between the first and fourth top panels and a side, the second top panel defining a slot for permitting passage of the handle therethrough and a hinge defining an end portion dimensioned and configured to fit between the first and fourth top panels and a side;

placing multiple reels of film within the box; and transporting the box to a desired location.

9. The method according to claim 8, further comprising:

providing the box in a collapsed configuration;

expanding the box, bending the bottom towards its locked position; and placing a fifth bottom panel above the bottom.

10. The method according to claim 8, further comprising:

closing the first top panel;

closing the fourth top panel over the first top panel, inserting the handle through the slot defined within the fourth top panel;

closing the third top panel over the fourth top panel, inserting the end portion between a side and the first and fourth top panels, and inserting the handle through the slot defined within the third top panel; and closing the second top panel over the third top panel, inserting the end portion between a side and the first and third top panels, and inserting the handle through the slot defined within the second top panel.

11. The method according to claim 10:

wherein the box further has a closure flap defined on a side of the box opposite the second top panel, the closure flap being dimensioned and configured to removably fit within the closure slot, the closure flap further defining a vertical portion, a horizontal portion, a live hinge therebetween, and an opening tab protruding upward from the vertical portion; and further comprising inserting the closure flap into the closure slot.

12. The method according to claim 8, wherein the multiple reels of film comprise a complete movie.

13. The method according to claim 8, further comprising standing the reels of film on their edge.

* * * * *